US010243252B2

(12) United States Patent
Iwakami

(10) Patent No.: US 10,243,252 B2
(45) Date of Patent: Mar. 26, 2019

(54) ANTENNA MOUNTING COMPONENT AND ANTENNA DEVICE

(71) Applicant: Kenichi Iwakami, Katagami (JP)

(72) Inventor: Kenichi Iwakami, Katagami (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 50 days.

(21) Appl. No.: 15/652,441

(22) Filed: Jul. 18, 2017

(65) Prior Publication Data

US 2018/0026328 A1 Jan. 25, 2018

(30) Foreign Application Priority Data

Jul. 21, 2016 (JP) ..... 2016-142947

(51) Int. Cl.
*H01Q 1/20* (2006.01)
*H01Q 1/12* (2006.01)
*H01Q 1/32* (2006.01)

(52) U.S. Cl.
CPC ..... *H01Q 1/20* (2013.01); *H01Q 1/1214* (2013.01); *H01Q 1/3275* (2013.01)

(58) Field of Classification Search
CPC ..... H01Q 1/20; H01Q 1/12; H01Q 1/32
USPC ..... 343/713
See application file for complete search history.

(56) References Cited

U.S. PATENT DOCUMENTS

2006/0214860 A1 9/2006 Hayashi et al.
2008/0100521 A1 5/2008 Herbert et al.
2009/0066593 A1 3/2009 Jared et al.
2013/0112837 A1* 5/2013 Spagnolo ..... H01Q 1/1214 248/535

FOREIGN PATENT DOCUMENTS

JP 3956473 B2 8/2007
JP 4780640 B2 9/2011
JP 5112465 B2 1/2013

OTHER PUBLICATIONS

Extended European Search Report (EESR) dated Nov. 13, 2017 issued in counterpart European Application No. 17181868.5.

* cited by examiner

*Primary Examiner* — Andrea Lindgren Baltzell
(74) *Attorney, Agent, or Firm* — Holtz, Holtz & Volek PC

(57) ABSTRACT

An antenna mounting component to be mounted to a fixing aperture on a mounting face of a car body, includes: a male screw for fixing an antenna; a protrusion provided on an antenna base, the protrusion having a female screw corresponding to the male screw; and a legged washer having multiple legs, the male screw being inserted into the legged washer, the legs being to be fixed onto the mounting face. The multiple legs are disposed at an equal interval in a circumferential direction around the inserted male screw through the legged washer; and distances in a radial direction from the inserted male screw to the respective contact points of the multiple legs with the mounting face are equal.

7 Claims, 8 Drawing Sheets

ANTENNA MOUNTING COMPONENT AND ANTENNA DEVICE

CROSS-REFERENCE TO RELATED APPLICATIONS

This application is based upon and claims the benefit of priority from the prior Japanese Patent Application No. 2016-142947, filed on Jul. 21, 2016, the entire contents of which, including the specification, claims, drawings and abstract, are incorporated herein by reference.

BACKGROUND OF THE INVENTION

1. Field of the Invention

The present invention relates to an antenna mounting component and an antenna device.

2. Description of Related Art

On-vehicle antennas, such as rod antennas, are known that are mounted onto car bodies to receive radio waves of, for example, AM/FM radio broadcast. An antenna-mounting structure onto a car body is known that includes a male screw (bolt) to be inserted into a fixing aperture formed in an antenna base and provided on the roof of the car body, and a female screw (nut) for tightening the male screw from the inside of the car (see Japanese Patent Nos. 3956473 and 4780640).

Unfortunately, the antenna-mounting structures in Japanese Patent Nos. 3956473 and No. 4780640 provides the male screw and female screw (, washer) as separate components, leading to troublesome mounting work and long man-hours for assembly. Another antenna-mounting structure is known that includes a female screw formed on an antenna base, a male screw hole, a stiffening plate, and a legged washer having a square shape with rectangular legs provided along the entire lengths of the three of the four sides and radially unfolding around the axis through tightening of a male screw into the female screw hole, in order to readily mount the antenna to the car body (see Japanese Patent No. 5112465). The male screw, the stiffening plate, and the legged washer are temporarily fastened through the female screw hole (the antenna base) integrally with the three legs folded. The integral antenna-mounting structure is inserted into the fixing aperture on the roof of the car body, to cause the male screw to be tightened. The legs of the legged washer then unfold in three directions, such that the antenna is mounted onto the car body.

Recent automobiles have a thin roof for weight saving. Unfortunately, the antenna-mounting structure described in Japanese Patent No. 5112465 may cause the leg claws of the legged washer to come into contact with the roof surface when the antenna is fixed thereon, leading to warping distortion because of decreased robustness of the thin roof. In particular, the antenna-mounting structure described in Japanese Patent No. 5112465 has legs only on three sides; hence, the axial force transmitted from the male screw to the roof is not balanced, causing a warping distortion on the roof. The warping distortion visually stands out and harms the design of the car body.

SUMMARY OF THE INVENTION

The object of the present invention is to readily mount the antenna to the car body and reduce the warping distortion on the mounting face.

To achieve at least one of the above mentioned objects, according to an aspect of the present invention, there is provided an antenna mounting component to be mounted to a fixing aperture on a mounting face of a car body, including: a male screw for fixing an antenna; a protrusion provided on an antenna base, the protrusion having a female screw corresponding to the male screw; and a legged washer having multiple legs, the male screw being inserted into the legged washer, the legs being fixed onto the mounting face; wherein the multiple legs are disposed at an equal interval in a circumferential direction around the inserted male screw through the legged washer; and distances in a radial direction from the inserted male screw to the respective contact points of the multiple legs with the mounting face are equal.

Preferably, in the antenna mounting component, the protrusion has leg guides on sidewalls for guiding the multiple legs onto the mounting face; the leg guides having: first slopes having a relatively large inclination in the radial direction around the inserted male screw; and second slopes having an inclination smaller than the inclination of the first slopes.

Preferably, in the antenna mounting component, the legs have rounded grooves; and the protrusion has the sidewalls including rounded protruding groove guides corresponding to the grooves and guiding the multiple legs onto the mounting face.

Preferably, in the antenna mounting component, the protrusion includes a temporal-fixing claw provided on a sidewall that does not correspond to the legs and is latched into the fixing aperture.

Preferably, in the antenna mounting component, the leg includes: longitudinal walls disposed on opposing sides of the top of each of the legs; and claws on the top of the longitudinal walls.

Preferably, in the antenna mounting component, the legs have claws, respectively, on the top; and the antenna base includes height adjusters protruding from the fixing aperture at the height being substantially flush with the mounting face such that the claws coming into contact with the height adjusters through tightening of the male screw into the female screw.

To achieve at least one of the above mentioned objects, according to another aspect of the present invention, there is provided an antenna device including: an antenna mounting component according to claim 1; and an antenna.

The present invention can readily mount an antenna to a car body and reduce warping distortion.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

The embodiments and their modifications of the present invention will now be described in reference to the accompanying drawings. The scope of the present invention, however, should not be limited to the illustrated embodiments and modifications.

Embodiments

Figure 1:
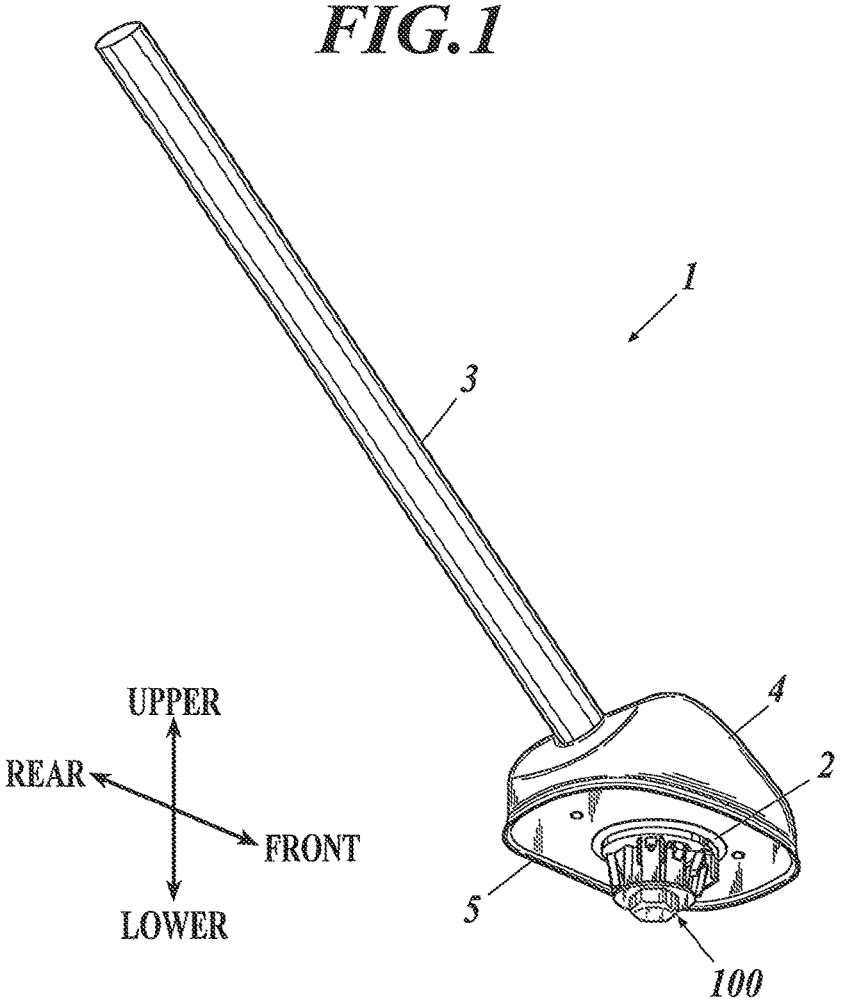
FIG. 1 is a perspective view of an antenna device according to an embodiment of the present invention.
Figure 2:
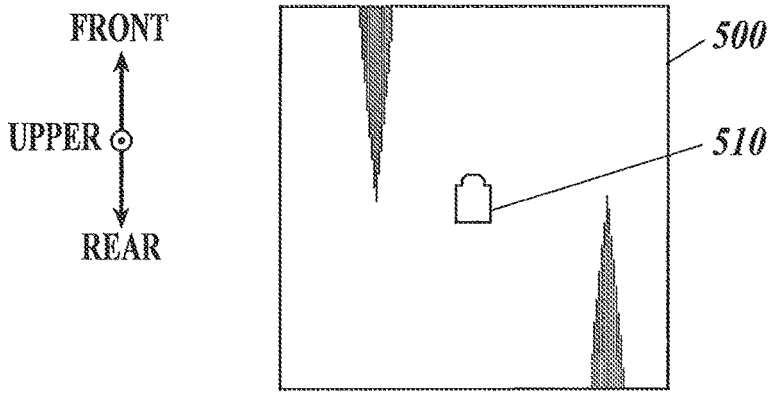
FIG. 2 is a plan view of a first mounting face having a first fixing aperture.

The embodiments of the present invention will now be described in reference to FIGS. 1 to 9. The overall configuration of a device according to the present embodiment will be described in reference to FIGS. 1 to 4. FIG. 1 is a perspective view of an antenna device 1 according to the present embodiment. FIG. 2 is a plan view of amounting face 500 having a fixing aperture 510.

The antenna device 1 according to the present embodiment is an on-vehicle antenna mounted on the roof (mounting face) of a car body. The antenna device 1 may be used for reception of AM/FM broadcast, for example, but not limited thereto, and may also be used for any other communication schemes, such as GSM (registered trademark) (Global System for Mobile communications).

The antenna device 1 includes an antenna base 2, an antenna 3, an antenna cover 4, and a gasket 5, as illustrated in FIG. 1. The antenna device 1 also has an antenna mounting portion 100 as an antenna component, which includes a portion of the antenna base 2 and mounts an antenna to the car body.

The antenna base 2 is the base of the antenna device 1, and is made of a die cast metal, such as aluminum. The antenna base 2 has a top face on which an antenna substrate (riot shown) is fixed. A tuning circuit and an amplifier circuit are disposed for selectively receiving only specific frequencies of radio waves. The antenna substrate is electrically connected with various types of cables, such as RF cables, electric wires, and grounding wires, for connection with communication devices provided within the car body.

The antenna 3 is a bar or rod antenna. The antenna 3 includes, for example, a rod support, a conductor wire as an antenna element spirally wound on the support in the shape of a bar, and an insulating material covering the antenna element. The antenna element is electrically connected with the antenna substrate.

The antenna cover 4 covers the antenna base 2 and the antenna substrate on the antenna base 2, for example, and supports the antenna 3. In other words, the antenna 3 is fixed with the antenna cover 4 to the antenna base 2.

The gasket 5 is mounted to the bottom of the antenna base 2. The gasket 5 is held between the antenna base 2 and a mounting face 500, which will be discussed below, of the car body after the antenna device 1 is mounted on the car body, and has a function to keep water tightness in the antenna cover 4 and the inside of the car.

The mounting face 500 or roof of the car body has the fixing aperture 510 thereon, as illustrated in FIG. 2. The antenna device 1 is mounted into the fixing aperture 510 on the mounting face 500 through the antenna mounting portion 100. For a reduction in weight of the car body, the thickness of the mounting face 500 is determined to be 0.6 mm or 0.5 mm, for example. The fixing aperture 510 is a through hole which has a substantially rectangular shape with a protrusion on its top side.

As illustrated in FIGS. 1 and 2, defined are the upper (to the outside of the car) and lower (to the inside of the car) directions perpendicular to the bottom face of the antenna base 2 of the antenna device 1 or the plane on the mounting face 500 in the position of the fixing aperture 510, after the antenna device 1 is mounted to the mounting face 500. Also defined are front and rear directions perpendicular to the upper and lower directions and relative to the antenna device 1 or the mounting face 500 (car body).

Figure 3:
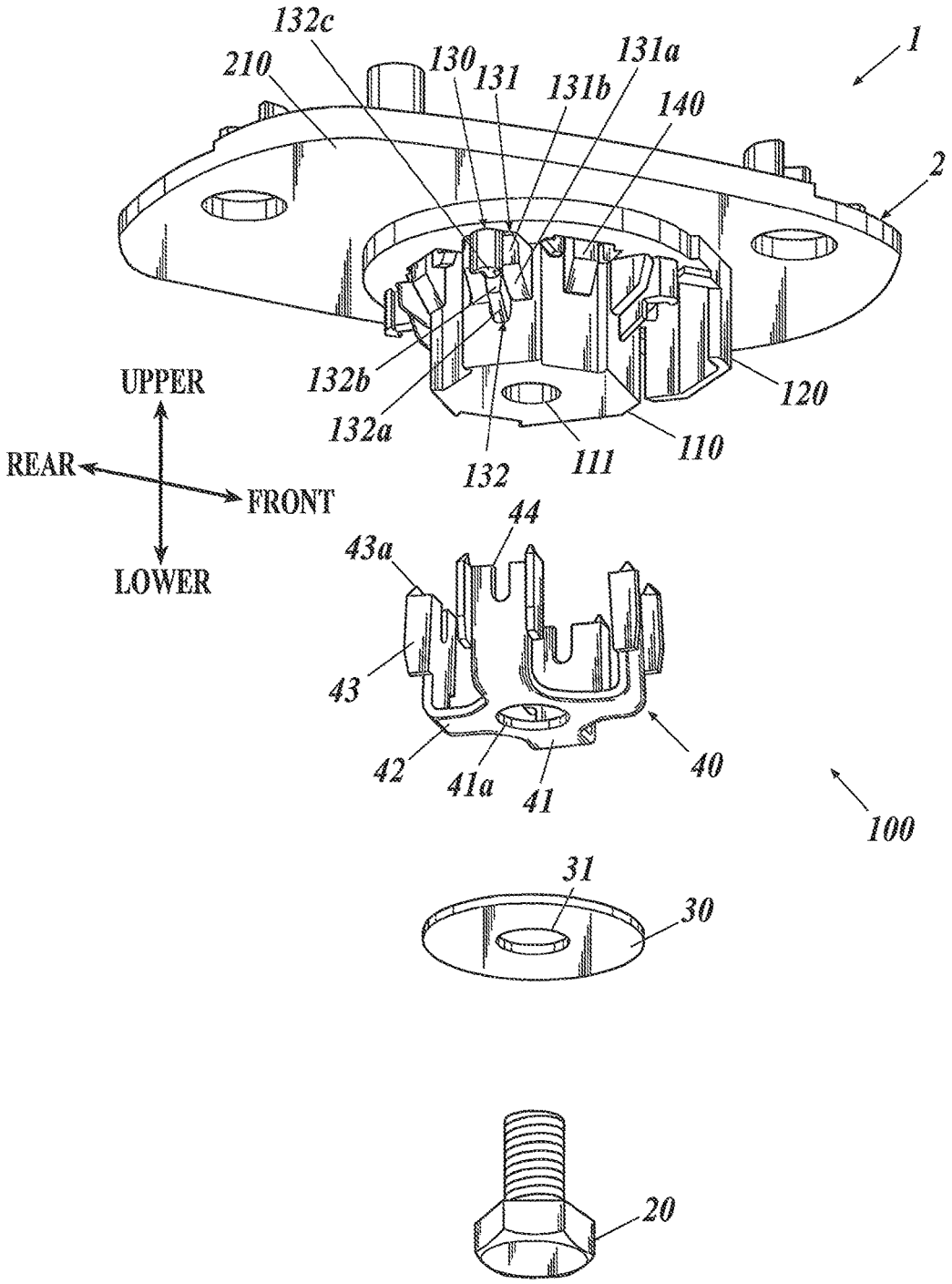
FIG. 3 is an exploded view of the lower portion of the antenna device.
Figure 4:
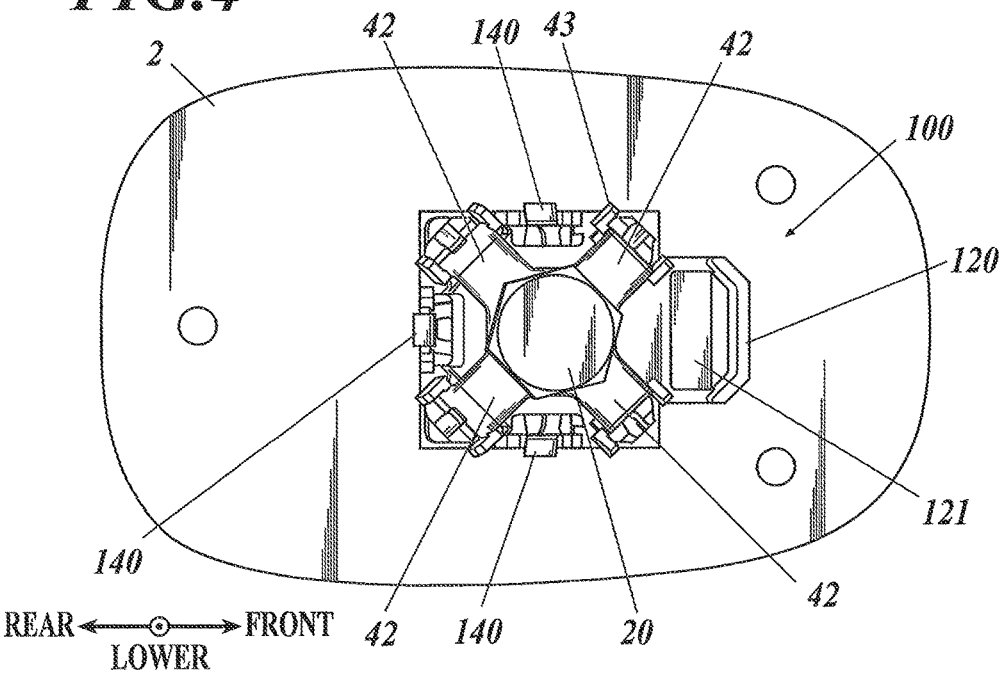
FIG. 4 is a bottom view of the antenna device.

The configuration of the antenna mounting portion 100 will now be described in reference to FIGS. 3 and 4. FIG. 3 is an exploded view of the lower portion of the antenna device 1. FIG. 4 is a bottom view of the antenna device 1. For clarity, a stiffening plate 30 is not depicted in FIG. 4, and the gasket 5 is not depicted in FIGS. 3 and 4.

The antenna base 2 includes a plane 210 as a main part of the base, a protrusion 110 as a part of the antenna mounting portion 100, a cable guide 120, a washer guide 130, and temporal-fixing claws 140, as illustrated in FIG. 3. The antenna mounting portion 100 includes a male screw 20 for fixing the antenna, the stiffening plate 30, and a legged washer 40.

The plane 210 is integrated with the protrusion 110, the cable guide 120, and washer guides 130 as a die cast. The temporal-fixing claws 140 are made of resins, for example, and are mounted to the protrusion 110 as a die cast.

The protrusion 110 has a shape of an substantially octagonal shape downwardly extending from the plane 210 and having eight sidewalls, and has a female screw 111 disposed in the center of the bottom surface and in the vertical axial direction.

The cable guide 120 is provided anterior to the protrusion 110 on the plane 210, and downwardly protrudes. A cable hole 121 is provided between the protrusion 110 and the cable guide 120 in the plane 210, as illustrated in FIG. 4. Various types of cables are connected with the antenna substrate provided on the antenna base 2, and extends through the cable hole 121 toward the interior of the car body. The cable guide 120 guides the various types of cables extending through the cable hole 121 toward the interior of the car body.

The washer guides 130 are respectively provided on every second sidewall, four of eight sidewalls of the protrusion 110. The washer guides 130 each include a leg guide 131 and a groove guide 132. The leg guides 131 guides legs 42, which will be discussed below, of a legged washer 40 in the direction of the mounting face 500 (upper direction), when the antenna device 1 is mount onto the mounting face 500.

The leg guides 131 have slopes 131*a* with a relatively large inclination radially extending around the axis of the protrusion 110, and slopes 131*b* with an inclination smaller than that of the slopes 131*a*, in the upper direction.

The groove guides 132 guides grooves 44, which will be discussed below, of a legged washer 40 in the direction of the mounting face 500, when the antenna device 1 is mounted to the mounting face 500. The groove guides 132 also serve as a positioner preventing the legged washer 40 from rotating in the circumferential direction due to the grooves 44 fitted into the groove guides 132, where the legged washer 40 also moves in the circumferential direction in cooperation with rotation of the male screw 20 in order to fasten the legged washer 40. The groove guides 132 are disposed in the center of the leg guides 131 and have a rounded corner. The groove guides 132 are highly robust because the corner is rounded. The groove guides 132 include rounded slopes 132*a* corresponding to the inclination of the slopes 131*a*, slopes 132*b* corresponding to the inclination of the slopes 131*b*, and rounded groove fixtures 132*c* to which the grooves 44 are fixed through fitting.

The temporal-fixing claws 140 temporarily fix the antenna device 1 to the fixing aperture 510, when the antenna device 1 is mounted to the mounting face 500. The temporal-fixing claws 140 are respectively provided on every second sidewall excluding the one on the side of the cable guide 120 and the one on which the washer guide 130 is provided, i.e., on three of the eight sidewalls of the protrusion 110.

The male screw 20 is a bolt mating to the female screw 111. The stiffening plate 30 is a disk washer having a hole for the male screw 20. The legged washer 40 transmits the axial force (tightening force) of the male screw 20 to the mounting face, and is made of steel, for example. The steel for the legged washer 40 maybe quenched and annealed in order to enhance the toughness.

The legged washer 40 includes a plane 41, and four legs 42 extending from the plane 41. The legs 42 have longitudinal walls 43 and grooves 44. The plane 41 is a pseudo-ring plane having a hole 41a for the male screw 20 in the center, and supports the four legs 42.

The legs 42 are a movable or deformable member, and radially extend from the plane 41 around the axis, and are orthogonally bent to extend upwardly. The longitudinal walls 43 are disposed on the opposing sides of the top of the respective legs 42, and are orthogonally bent relative to the legs 42, such that the robustness of the legs 42 is enhanced. The respective longitudinal walls 43 have two claws 43*a* on the top. The claws 43*a* stick onto the mounting face 500. The grooves 44 are formed in the center of the top of the respective legs 42, and have a rounded corner.

The four legs 42 extend around the axis of the male screw 20 from the lower direction and at an equal interval (every 90 degrees) in the circumferential direction, as illustrated in FIG. 4.

Figure 5:
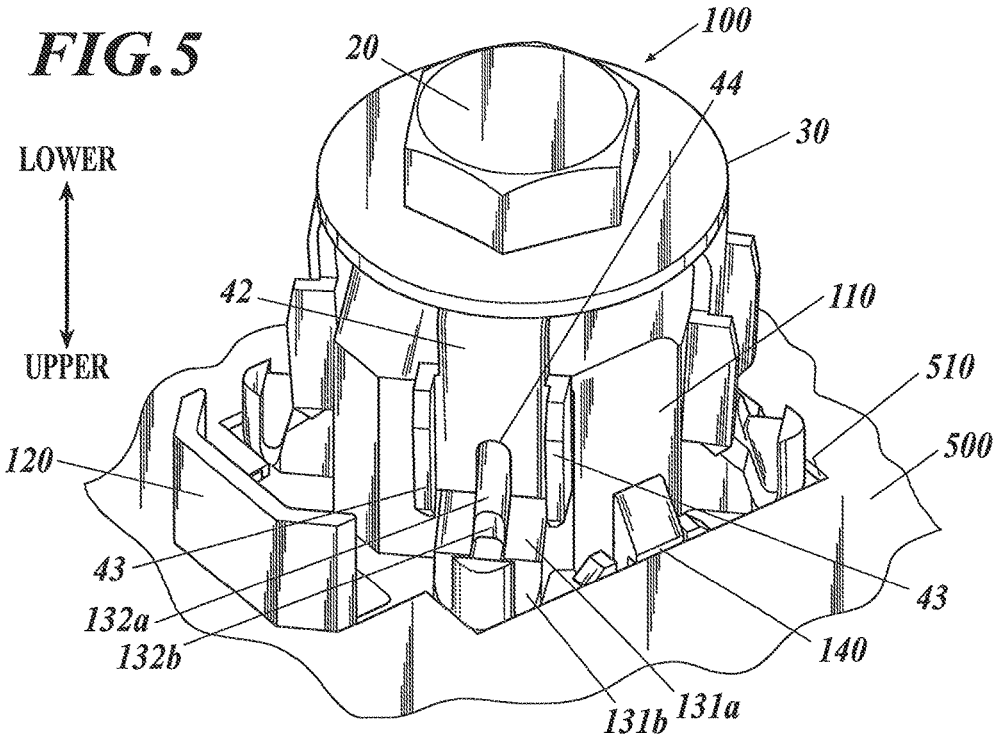
FIG. 5 illustrates a first antenna mounting portion in the initial mounting state.
Figure 6:
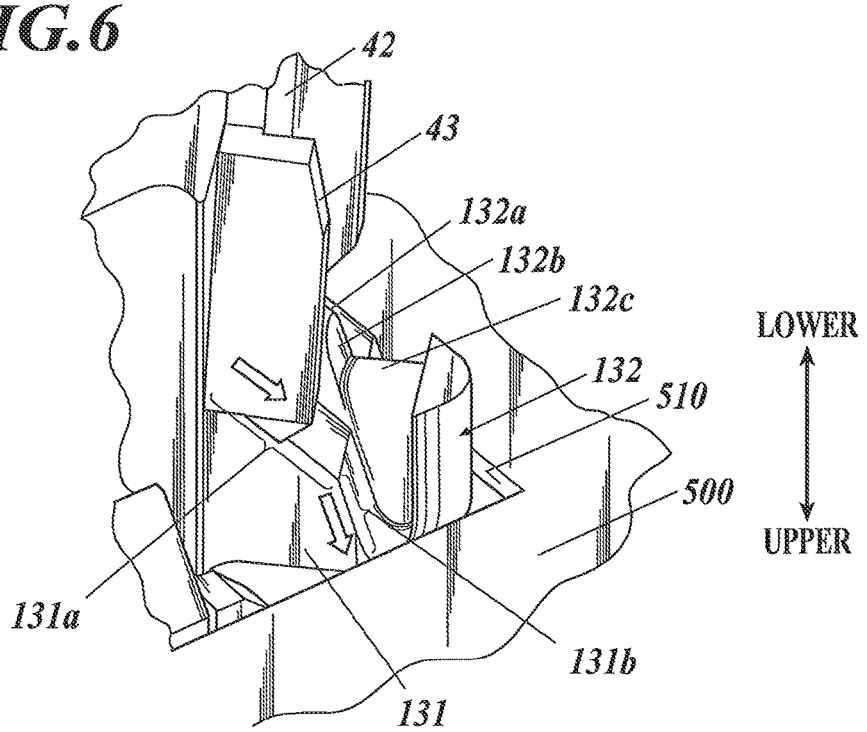
FIG. 6 is an enlarged view of slopes of the first antenna mounting portion in the initial mounting state.
Figure 7:
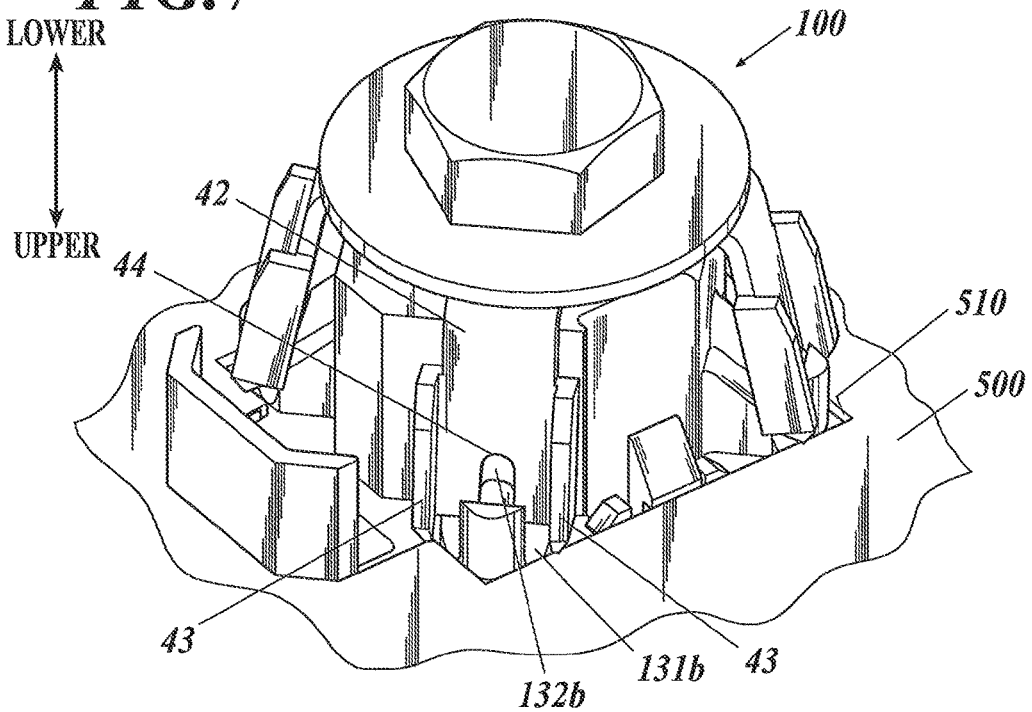
FIG. 7 illustrates the first antenna mounting portion in the semi-mounting state.
Figure 8:
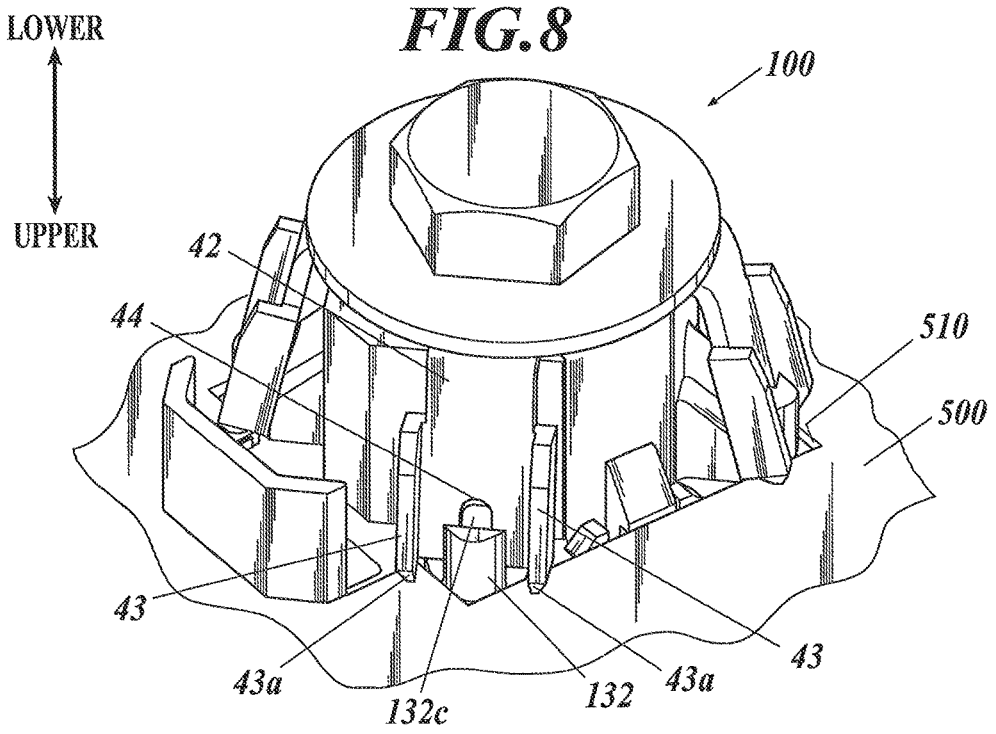
FIG. 8 illustrates the first antenna mounting portion in the mounted state.

How the antenna device 1 is mounted to the mounting face 500 of the car body by a worker will now be described in reference to FIGS. 5 to 8. FIG. 5 illustrates an antenna mounting portion 100 in the initial mounting state. FIG. 6 is an enlarged view of slopes of the antenna mounting portion 100 in the initial mounting state. FIG. 7 illustrates the antenna mounting portion 100 in the semi-mounting state. FIG. 8 illustrates the antenna mounting portion 100 in the mounted state.

As illustrated in FIG. 1, the antenna device 1 has been integrally assembled at the time when the antenna device 1 is mounted to the mounting face 500. The male screw 20 has been tightened into the female screw 111 through stiffening plate 30 and the legged washer 40, in the antenna mounting portion 100 in the initial mounting state. The degree of tightening, however, is small.

With reference to FIGS. 5 and 6, the worker inserts and temporarily fixes the antenna mounting portion 100 of the antenna device 1 in the initial state into the fixing aperture 510 on the mounting face 500 from the upper part (from the outside of the car) to the lower part (to the inside of the car). Three of the temporal-fixing claws 140 are latched to the inside of the fixing aperture 510, in the initial state in which the antenna mounting portion 100 is temporarily fixed. The antenna mounting portion 100, therefore, cannot be detached from the fixing aperture 510, even if the worker exerts upward force from the lower direction (from the inside of the car) on the antenna mounting portion 100 for fastening.

The four legs 42 are in contact with every second sidewall of the protrusion 110, respectively, in the temporarily fixed antenna mounting portion 100 in the initial state. The tops of the legs 42 are in contact with the slopes 131*a* on the respective sidewalls. The grooves 44 of the legs 42 are respectively in contact with the slopes 132*a* on the sidewalls.

The worker tightens the male screw 20, which exerts an upward axial force onto the legged washer 40. With reference to FIGS. 6 and 7, this is accompanied by the deformation of the legs 42, the tops of which are guided to the slopes 131*a* with a relatively large inclination of the respective leg guides 131 to slip on them. The grooves 44 are also guided to the slopes 132*a* with a relatively large inclination of the respective groove guides 132 to slip on them, and the respective legs 42 are radially unfolded around the axis. With reference to FIG. 6, the arrows indicate the direction of the deformation of the legs 42. Since the slopes 132*a* of the groove guides 132 have a rounded corner, the torque exerted in the circumferential direction is released when the male screw 20 is tightened, causing the grooves 44 to move on the slopes 132*a* smoothly. The legs 42 deform in the antenna mounting portion 100 in this manner, and rapidly unfold radially around the axis of the male screw 20 when viewed from below.

The worker then completely tightens the male screw 20, which exerts an upward axial force onto the legged washer 40. With reference to FIGS. 6 and 8, this is accompanied by the deformation of the respective legs 42, the tops of which are guided to the slopes 131*b* with a relatively small inclination of the respective leg guides 131, to slip on the slope and come into contact with the mounting face 500. The grooves 44 are also guided to the slopes 132*b* with a relatively small inclination of the respective groove guides 132, to slip on the slopes and come into contact with the groove fixtures 132*c* for fixing. As illustrated in FIG. 6, the first slopes 131*a* (slopes 132*a*) have a larger inclination than the second slopes 131*b* (slopes 132*b*) from the lower portion to the upper portion. The respective legs 42 deform in the antenna mounting portion 100 in this manner, and slowly unfold radially around the axis of the male screw 20 when viewed from below. All of the eight claws 43*a* finally stick onto the mounting face 500. This allows the respective legs 42 to stick onto the mounting face 500 without excess unfolding, and permits the antenna device 1 to be fixed to the mounting face 500. The claws 43*a*, which stick onto a coated layer on the mounting face 500 to come into contact with a conductor portion, allow the antenna base 2 to electrically connect with the car body through the antenna mounting portion 100 for grounding. The distances in the radial direction around the male screw 20 to the respective contact points of the four legs 42 with the mounting face 500 are equal when viewed from below. Namely, the distances in the radial direction from the male screw 20 to the respective contact points of the four legs 42 with the mounting face 500 are equal.

Figure 9:
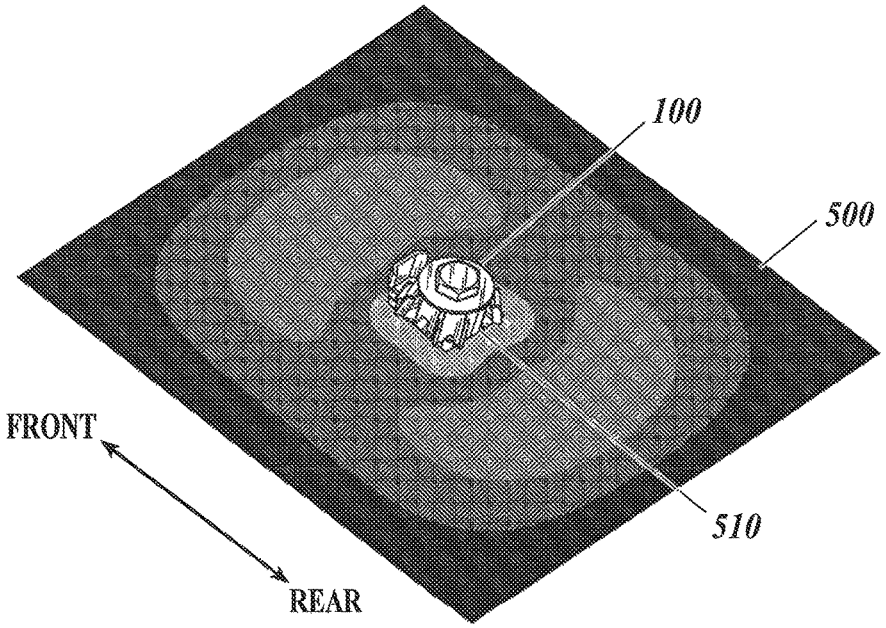
FIG. 9 illustrates the amount of distortion on the first mounting face on which the first antenna mounting portion is mounted.

With reference to FIG. 9, the results of calculation of the amount of distortion on the mounting face 500 will now be described when the antenna mounting portion 100 according to an example embodiment is mounted to the mounting face 500. FIG. 9 illustrates the amount of distortion on the mounting face 500 on which the antenna mounting portion 100 is mounted.

The amount of distortion (mm) as an amount of displacement in the vertical direction at each point on the mounting face 500 was calculated for the case in which the antenna mounting portion 100 of the antenna device 1 was mounted to the mounting face 500 made of a steel plate having the size of 300 mm×300 mm and the thickness T=0.6 mm. The male screw 20 was tightened with the torque of 6 N/m.

In FIG. 9, the black portion indicates the smallest amount of distortion at each point on the mounting face 500, and the color gradually changes from black to white as the amount of distortion increases. The relation of the colors with the amount of distortion is the same in FIGS. 13 and 14, which will be discussed below.

As illustrated in FIG. 9, a large amount of warping distortion was not generated around the antenna mounting portion 100 mounted to the mounting face 500.

According to the present embodiment, the antenna mounting portion 100 includes the male screw 20, the protrusion 110 provided on the antenna base 2 and having the female screw 111 corresponding to the male screw 20, and the legged washer 40 having the four legs 42, and the male screw 20 is inserted therein such that the legs 42 are mounted onto the mounting face 500 of the car body. The four legs 42 are disposed at an equal interval in the circumferential direction around the inserted male screw 20 through the legged washer 40, and the distances in the radial direction around the inserted male screw 20 to the respective contact points of the four legs 42 with the mounting face 500 are equal.

The antenna device 1 also includes the antenna mounting portion 100 and the antenna 3.

Such a structure facilitates mount of the antenna to the car body and can reduce the warping distortion on the mounting face 500. The design of the car body, therefore, can be maintained without the noticeable warping distortion depending on the intensity of a light. Furthermore, the placement of the legs 42 at an equal interval in the circumferential direction enables the temporal-fixing claws 140 and the cable hole 121 to be securely disposed at vacant sites.

The protrusion 110 also includes the leg guides 131 to guide four legs 42 onto the mounting face 500, on the sidewalls. The leg guides 131 have the slopes 131*a* with a relatively large inclination in the radial direction and the slopes 131*b* with a smaller inclination than that of the slopes 131*a*, around the inserted male screw 20. The leg guides 131, therefore, can securely guide the legs 42 onto the mounting face 500 to sufficiently unfold the legs 42 radially through slopes 131*a*. The leg guides 131 can also fix the legs 42 onto the mounting face 500 through the slope 131*b*, such that the legs 42 do not excessively unfold, which can reduce the size of the antenna mounting portion 100.

The legs 42 also include the grooves 44 with a rounded corner. The protrusion 110 has sidewalls having the rounded and protruding groove guides 132 that correspond to the grooves 44 and guide the four legs 42 onto the mounting face 500. This can allow the torque exerted in the circumferential direction to escape when the male screw 20 is tightened, and can securely guide the legs 42 onto the mounting face 500, eventually enhancing the robustness of the protrusion 110.

The protrusion 110 also includes the three temporal-fixing claws 140 provided on the sidewalls that do not correspond to the legs 42, and latched into the fixing aperture 510. The legs 42 are thereby disposed at an equal interval in the circumferential direction, which enables temporal-fixing claws 140 to be securely disposed at vacant sites. The three temporal-fixing claws 140 can restrain the antenna mounting portion 100 from rattling in temporal fixing and also prevent the antenna mounting portion 100 (antenna device 1) to be misaligned in tightening (final tightening) of the male screw 20, thus enhancing the characteristics of the antenna.

The legs 42 include longitudinal walls 43 provided on the opposing sides on the top of the respective legs 42, and the claws 43*a* on the top of the respective longitudinal walls 43. The eight claws 43*a* stick onto the mounting face 500 through tightening of the male screw 20 into the female screw 111. This enables the axial force through tightening of the male screw 20 to be evenly transmitted onto the mounting face 500 by the eight claws 43*a*, further reducing the warping distortion on the mounting face 500.

(Modifications)

The modifications of the embodiments above will now be described in reference to FIGS. 10 to 14. The modifications provide a configuration of the antenna device 1 that includes an antenna mounting portion 100A instead of the antenna mounting portion 100 in the above-described embodiments, where the antenna mounting portion 100A is mounted onto a mounting face 500A.

Figure 10:
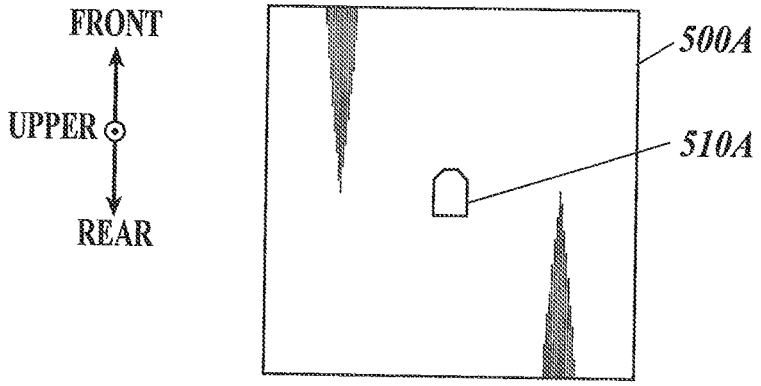
FIG. 10 is a plan view of a second mounting face having a second fixing aperture.

The mounting face 500A will be described in reference to FIG. 10. FIG. 10 is a plan view of the mounting face 500A having a fixing aperture 510A.

As illustrated in FIG. 10, the mounting face 500A or roof of the car body has the fixing aperture 510A thereon. The antenna device 1 is mounted into the fixing aperture 510A on the mounting face 500A through the antenna mounting portion 100A. The mounting face 500A has the same thickness as the mounting face 500. The fixing aperture 510A is a through hole which has a hexagonal shape in combination of an isosceles trapezoid and a rectangle.

The fixing aperture 510A has a different shape from that of the fixing aperture 510 in the embodiments described above. When the antenna mounting portion 100 in the embodiments above is mounted, the six of the eight claws 43*a* of the legged washer 40 stick onto the mounting face 500A, and the two rests do not contact with the mounting face 500A. The antenna mounting portion 100A thus includes height adjusters 150, which will be discussed below.

Figure 11:
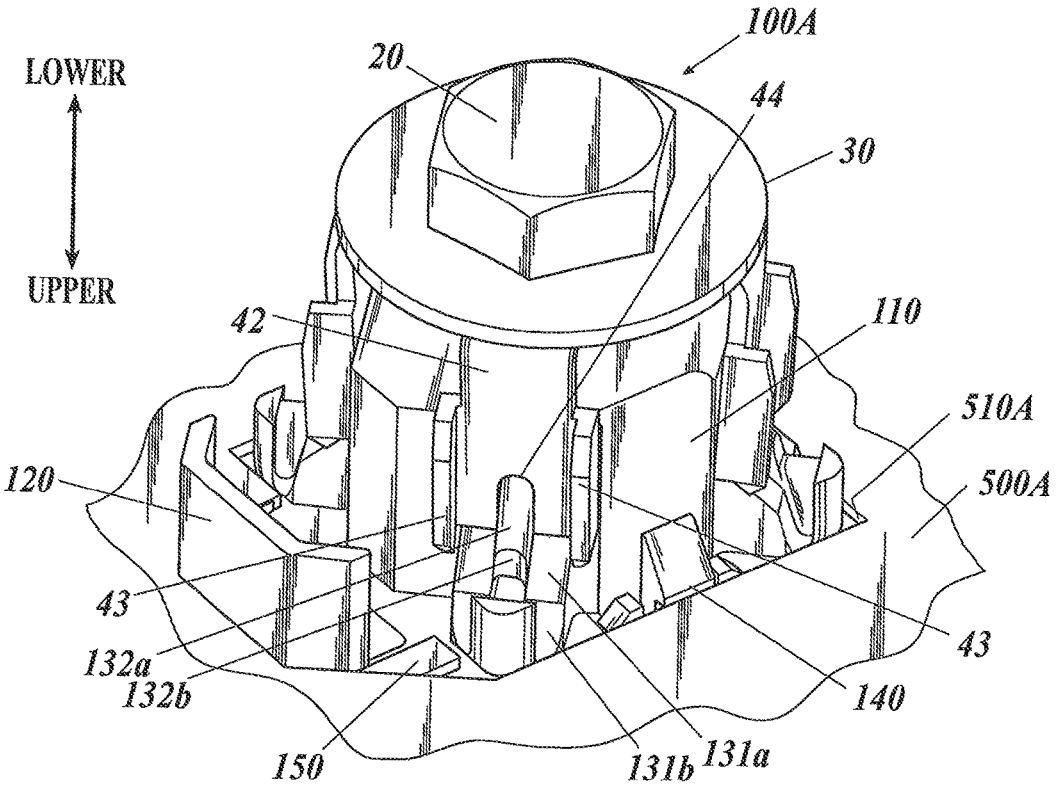
FIG. 11 illustrates a second antenna mounting portion in the initial mounting state.
Figure 12:
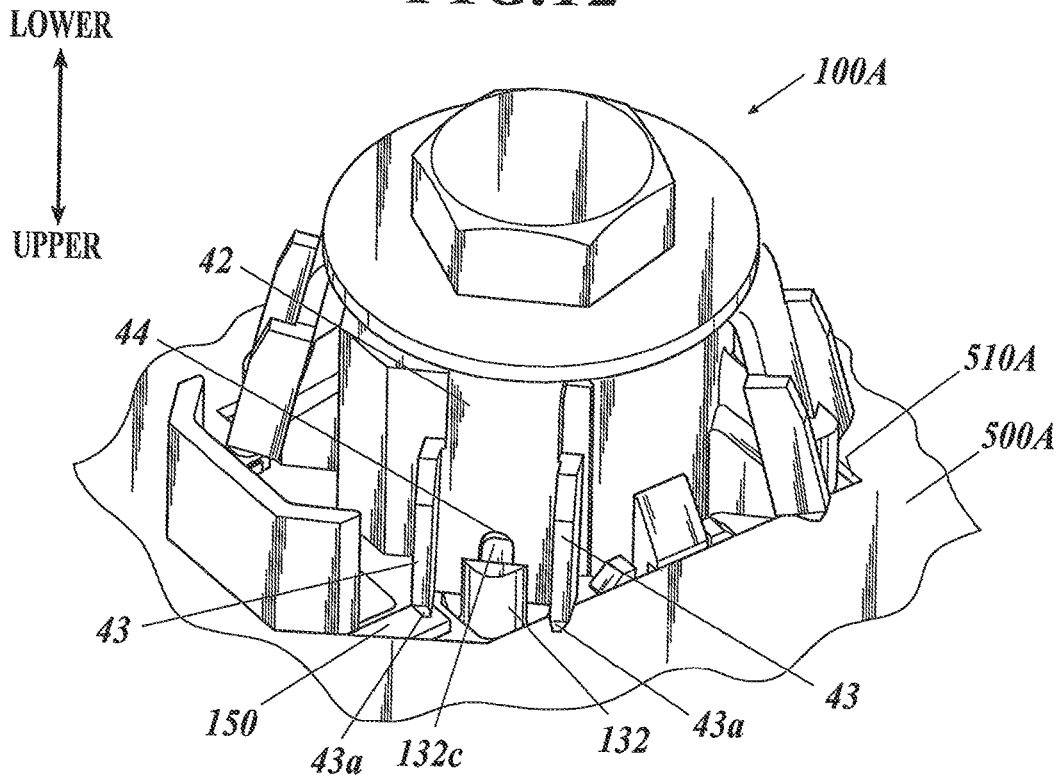
FIG. 12 illustrates the second antenna mounting portion in the mounted state.

With reference to FIGS. 11 and 12, the antenna mounting portion 100A and the mount of the antenna device 1 onto the mounting face 500A of the car body by a worker will now be described. FIG. 11 illustrates the antenna mounting portion 100A in the initial mounting state. FIG. 12 illustrates the antenna mounting portion 100A in the mounted state.

The antenna mounting portion 100A is substantially the same as the antenna mounting portion 100 in the embodiments describe above, except that the antenna base 2 further includes two height adjusters 150, as illustrated in FIG. 11. Each of the height adjusters 150 is formed integrally as a die cast of the antenna base 2, for example. The height adjusters 150 are disposed respectively in the positions of the claws 43*a* that do not come into contact with the mounting face 500 when the antenna mounting portion 100 is mounted, to raise and adjust the height of the plane 210 from the upper direction to the lower direction to the height of the mounting face 500A. In other words, the height adjusters 150 protrude from the fixing aperture 510A at a height being substantially flush with the mounting face 500A.

The antenna device 1 has been already integrated with the antenna mounting portion 100A, before the antenna device 1 is mounted to the mounting face 500A, as illustrated in FIG. 11. The worker then inserts and temporarily fixes the antenna mounting portion 100A of the antenna device 1 in the initial state into fixing aperture 510A on the mounting face 500A from the upper part (from the outside of the car) to the lower part (to the inside of the car).

The worker then tightens the male screw 20, which exerts an upward axial force onto the legged washer 40. The tops of the respective legs 42 are then guided to the slopes 131*a* with a relatively large inclination of the respective leg guides 131 to slip on them. The respective grooves 44 are also guided to the slopes 132*a* with a relatively large inclination of the respective groove guides 132 to slip on them.

Figure 13:
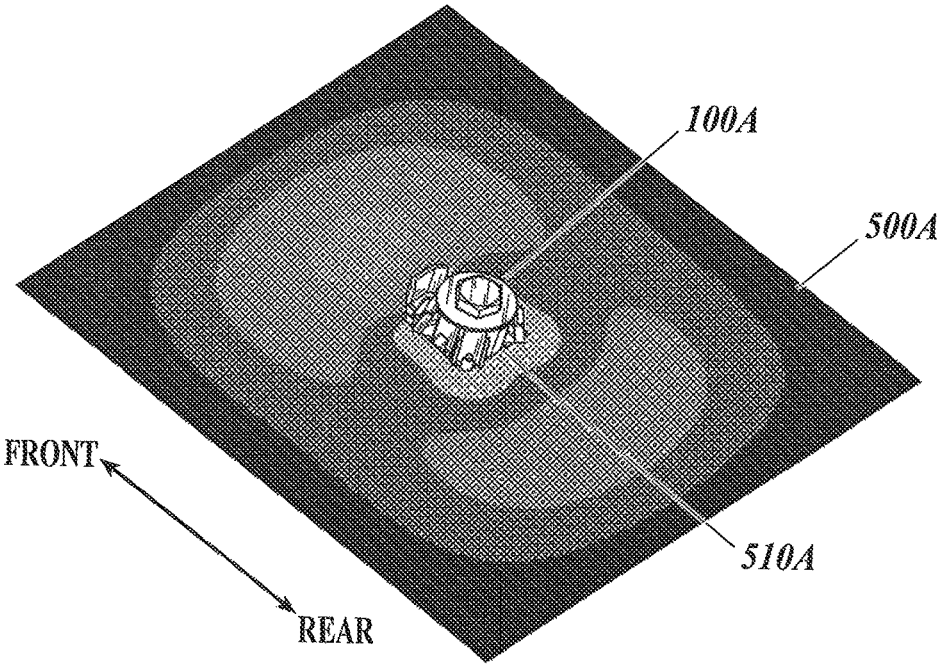
FIG. 13 illustrates the amount of distortion on the second mounting face on which the second antenna mounting portion is mounted.
Figure 14:
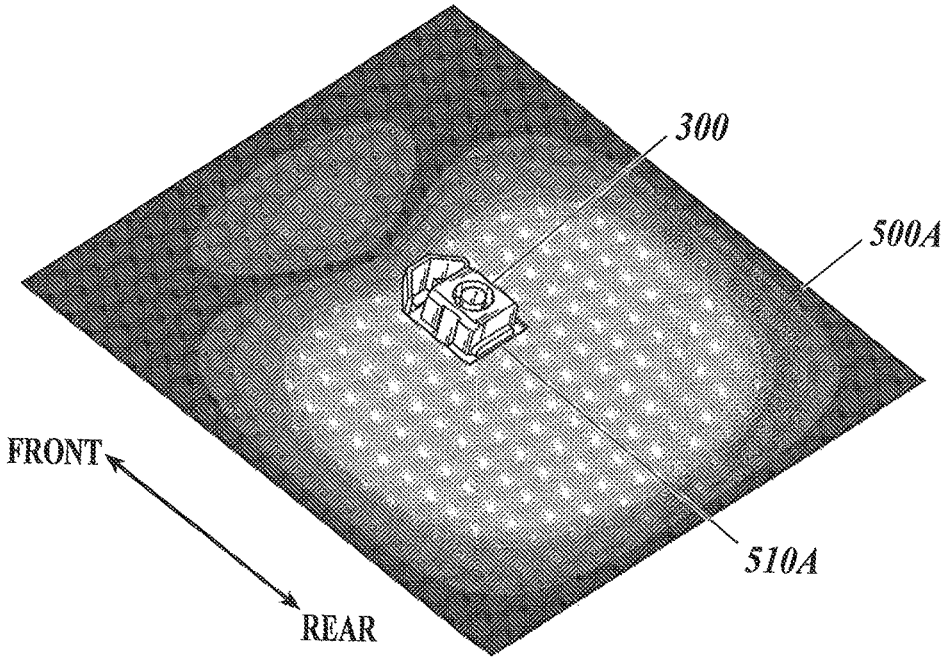
FIG. 14 illustrates the amount of distortion on the second mounting face on which an antenna mounting portion for a comparative example is mounted.

The worker then completely tightens the male screw 20, which exerts an upward axial force onto the legged washer 40, as illustrated in FIG. 12. The tops of the respective legs 42 are then guided to the slopes 131*b* with a relatively small inclination of the respective leg guides 131, to slip on the slopes and come into contact with the mounting face 500A. The respective grooves 44 are also guided to the slopes 132*b* with a relatively small inclination of the respective groove guides 132, to slip on the slopes and come into contact with the groove fixtures 132*c*. The respective legs 42 deform in the antenna mounting portion 100A in this manner, and slowly unfold radially around the axis of the male screw 20 when viewed from below. The six of the eight claws 43*a* finally stick onto the mounting face 500A, and the two rests of the claws 43*a* come into contact with the height adjusters 150. This allows the antenna device 1 to be fixed to the mounting face 500A With reference to FIGS. 13 and 14, the results of calculation of the distortion of the mounting face 500A will now be described when the antenna mounting portion 100A according to the present example and an antenna mounting portion 300 according to a comparative example are mounted onto the respective mounting faces 500A. FIG. 13 illustrates the amount of distortion on the mounting face 500A on which the antenna mounting portion 100A is mounted. FIG. 14 illustrates the amount of distortion on the mounting face 500A on which the antenna mounting portion 300 is mounted.

The amount of distortion at each point on the mounting face 500A in the vertical direction was calculated when the antenna mounting portion 100A of the antenna device 1 was mounted into the fixing aperture 510A on the mounting face 500A, under the same conditions as those in the antenna mounting portion 100 of the embodiments.

As illustrated in FIG. 13, large warping distortion was not generated around the antenna mounting portion 100A mounted to the mounting face 500A, although the amount and area of distortion around the antenna mounting portion 100A was larger than that around the antenna mounting portion 100 in the embodiments above.

The amount of distortion was calculated also for the antenna mounting portion 300 mounted to the mounting face 500A in the comparative example, under the same conditions as those in the antenna mounting portion 100A. The antenna mounting portion 300 includes the cable guide 120, the cable hole 121, a male screw, a stiffening plate, a legged washer, and a protrusion on an antenna base. The antenna mounting portion 300 has a substantially square plane formed by the stiffening plate and the legged washer. Three rectangular legs having claws respectively extend from the entire lengths of the three neighboring sides of the substantially square plane. Tightening of the male screw into the female screw in the protrusion causes the three legs to radially unfold around the axis such that the claws stick onto the mounting face 500A to mount the antenna mounting portion 300 to the mounting face 500A.

As illustrated in FIG. 14, the amount and area of distortion is larger than those of the antenna mounting portion 100 according to the embodiments described above and the antenna mounting portion 100A according to the present modification, especially around the rear of the antenna mounting portion 300 mounted on the mounting face 500A, indicating generation of large warping distortion.

According to the present modification, the antenna base 2 includes the height adjusters 150 that protrude from the fixing aperture 510A at the height being substantially flush with the mounting face 500A and that come into contact with the claws 43*a* through tightening of the male screw 20 into the female screw 111, in the antenna mounting portion 100A.

This can prevent the claws 43*a* from remaining unsettled after mounting the antenna mounting portion 100A onto the mounting face 500A, and enables the antenna mounting portion 100A to be securely fixed to the mounting face 500. Each of the claws 43*a* sticking onto the mounting face 500 or coming into contact with the height adjusters 150 can substantially evenly transmit the axial force through tightening of the male screw 20 onto mounting face 500, thus reducing the warping distortion on the mounting face.

The present invention made by the inventor has been specifically described based on the embodiments and their modifications. The present invention, however, should not be limited to the embodiments and modifications described above, and can be modified without departing from the scope and sprit of the present invention.

Although the embodiments and modifications above describe the configuration where the legged washer 40 has four legs 42, and the respective legs 42 (the longitudinal walls 43) have two claws 43*a*, for example, any other configurations may also be available. The legged washer 40 may have any number of multiple legs other than four that are disposed at an equal interval in the circumference around the male screw 20, or the respective legs may have one claw or three or more claws, for example.

The embodiments and modifications above also describe the configuration where the rod antenna device 1 is mounted onto the mounting faces 500, 500A, and any other configurations may be available. The antenna device having an antenna mounting component may include any other on-vehicle antennas such as shark-fin antennas.

The disclosed embodiments and modifications are mere illustrative in every respect and should not be construed to limit the invention. The scope of the present invention is defined by the accompanying claims, not by the description above, and any modification or variation of the present invention is intended to fall within claims in the sense of equivalence.

What is claimed is:

1. An antenna mounting component to be mounted to a fixing aperture on a mounting face of a car body, comprising:

a male screw for fixing an antenna;

a protrusion provided on an antenna base, the protrusion having a female screw corresponding to the male screw; and a legged washer having multiple legs, the male screw being inserted into the legged washer, the legs being fixed onto the mounting face; wherein the multiple legs are disposed at an equal interval in a circumferential direction around the inserted male screw through the legged washer; and distances in a radial direction from the inserted male screw to the respective contact points of the multiple legs with the mounting face are equal.

2. The antenna mounting component according to claim 1, wherein the protrusion has leg guides on sidewalls for guiding the multiple legs onto the mounting face;

the leg guides having:

first slopes having a relatively large inclination in the radial direction around the inserted male screw; and second slopes having an inclination smaller than the inclination of the first slopes.

3. The antenna mounting component according to claim 1, wherein the legs have rounded grooves; and the protrusion has the sidewalls including rounded protruding groove guides corresponding to the grooves and guiding the multiple legs onto the mounting face.

4. The antenna mounting component according to claim 1, wherein the protrusion comprises a temporal-fixing claw provided on a sidewall that does not correspond to the legs and is latched into the fixing aperture.

5. The antenna mounting component according to claim 1, the leg comprising:

longitudinal walls disposed on opposing sides of the top of each of the legs; and claws on the top of the longitudinal walls.

6. The antenna mounting component according to claim 1, wherein the legs have claws, respectively, on the top; and the antenna base comprises height adjusters protruding from the fixing aperture at the height being substantially flush with the mounting face such that the claws coming into contact with the height adjusters through tightening of the male screw into the female screw.

7. An antenna device comprising:

an antenna mounting component according to claim 1; and an antenna.

* * * * *